United States Patent [19]

Authier

[11] 4,313,244

[45] Feb. 2, 1982

[54] WOVEN SLIDE FASTENER STRINGER WITH MOLDED REINFORCING PROJECTIONS ON UPPER CONNECTING THREADS

[75] Inventor: Charles A. Authier, Meadville, Pa.

[73] Assignee: Talon, Inc., Meadville, Pa.

[21] Appl. No.: 73,964

[22] Filed: Sep. 10, 1979

[51] Int. Cl.[3] ..... A44B 19/04

[52] U.S. Cl. ..... 24/205.13 R; 24/205.16 R

[58] Field of Search ..... 24/205.1 R, 205.16 R, 24/205.13 R, 205.13 D

[56] References Cited

U.S. PATENT DOCUMENTS

| | | | |
|---|---|---|---|
| 4,033,014 | 7/1977 | Manning | 24/205.16 R |
| 4,080,691 | 3/1978 | Moertel | 24/205.16 R X |
| 4,140,157 | 2/1979 | Scott | 24/205.16 R X |
| 4,171,556 | 10/1979 | Moertel | 24/205.13 R |
| 4,186,467 | 2/1980 | Lawrence | 24/205.16 R |
| 4,210,985 | 7/1980 | Scott | 24/205.16 R |

*Primary Examiner*—Roy D. Frazier
*Assistant Examiner*—Peter A. Aschenbrenner
*Attorney, Agent, or Firm*—O'Brien & Marks

[57] ABSTRACT

A woven stringer for a slide fastener has reinforcing projections integral with molded coupling elements. The reinforcing projections extend only along upper connecting threads of four spaced connecting threads upon which the coupling elements are molded to permit free compressing and flexing of the lower connecting threads.

3 Claims, 6 Drawing Figures

WOVEN SLIDE FASTENER STRINGER WITH MOLDED REINFORCING PROJECTIONS ON UPPER CONNECTING THREADS

TECHNICAL FIELD

The invention relates to slide fasteners and particularly to woven slide fasteners employing polymer coupling elements molded on four or more spaced connecting threads woven in the edge of a support tape wherein the coupling elements have integrally molded projections extending parallel the connecting threads for reinforcing the union of the coupling elements on the connecting threads.

BACKGROUND ART

Slide fastener stringers having coupling elements molded on pluralities of spaced connecting threads are disclosed in U.S. Pat. Nos. 4,033,014, 4,084,296 and 4,140,157; the Pat. Nos. 4,033,014 and 4,140,157 particularly illustrating coupling elements molded on four spaced connecting threads. The polymer coupling elements are molded on the connecting threads with the coupling elements initially in a flat condition and the connecting threads only shallowly embedded within the legs of the coupling elements. Subsequently the leg portions of the coupling elements are folded together and each folded train of coupling elements is fed as an edge warp thread to a conventional tape weaving apparatus to weave each train of coupling elements in the edge of a tape as the tape is woven so that loops of the weft thread extend around the connecting threads to secure each coupling element train in the edge of the tape. Due to the connecting threads being only shallowly embedded within the leg portions, the connecting threads are subject to being pulled from the coupling elements during manufacture and later use of the slide fasteners. In U.S. patent application No. 817,718 filed July 21, 1977 by George B. Moertel for "Slide Fastener With Molded Elements And Method Of Manufacture", substantially improved woven slide fasteners are suggested including integrally molded projections of the coupling elements extending partially along the connecting threads to reinforce the connecting threads in their union with the coupling elements. These suggested reinforcement projections produce a substantial reduction in the separation of the molded coupling elements from the connecting threads, but do not completely eliminate such separation.

SUMMARY OF THE INVENTION

The invention is summarized in a woven stringer for a slide fastener including a plurality of spaced polymer coupling elements each having a head portion and a pair of leg portions extending in generally the same direction from opposite sides of the head portion and terminating in heels, four connecting threads, respective pairs of which have spaced segments embedded in the respective leg portions to join the coupling elements into a train wherein lower connecting threads of the respective pairs of connecting threads are disposed adjacent to the heels of the leg portions and upper connecting threads of the respective pairs of connecting threads are disposed intermediate the heels and the head portions, each coupling element having a pair of integrally molded projections of polymer extending in opposite directions from the respective leg portions of each coupling element along the upper connecting threads, a woven tape having a plurality of warp threads and a weft thread interwoven with the warp threads and the train of coupling elements such that a plurality of loops of the weft thread encircle the connecting threads and the projections between each adjacent pair of coupling elements, and the projections extending only partially across spaces between adjacent coupling elements and being spaced from the lower connecting threads so as to permit free compression of the lower connecting threads between adjacent coupling elements.

An object of the invention is to construct a woven slide fastener stringer having polymer coupling elements with leg portions molded on respective connecting threads and with improved reinforcing projections extending along the connecting threads wherein separation of the connecting threads from the coupling elements is substantially eliminated.

Another object of the invention is to substantially improve the ease of operation of a slide fastener employing stringers with molded coupling elements having projections extending along connecting threads woven in an edge of support tapes.

It is also an object of the invention to reduce wear on locking portions of coupling elements in slide fasteners of the disclosed type.

An advantage of the invention is that positioning of reinforcing projections along upper connecting threads and spaced from lower connecting threads allows free compressing and flexing of the lower connecting threads to substantially reduce stress and tension forces on the union of the upper connecting threads with the coupling elements.

One feature of the invention is that the reinforcing projections are only located along the line of pivoting or bending of the train of coupling elements thus allowing greater freedom of movement of portions of the coupling elements spaced from the bending line during opening and closing of the slide fastener.

Other objects, advantages and features of the invention will be apparent from the following description of the preferred embodment taken in conjunction with the accompanying drawings.

DESCRIPTION OF THE PREFERRED EMBODIMENT

Figure 1:
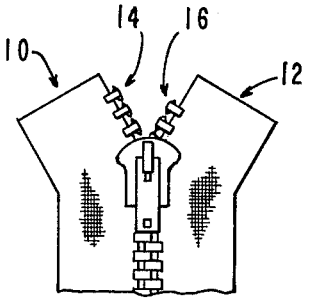
FIG. 1 is a plan view of a slide fastener constructed in accordance with the invention.

As illustrated in FIG. 1, a slide fastener with a pair of stringers in accordance with the invention includes pair of planarly disposed support tapes indicated generally at 10 and 12 and a pair of trains of coupling elements indicated generally at 14 and 16 attached to the respective inner edges of the tapes 10 and 12. A slider 18 is slidably mounted on the coupling elements 14 and 16 for opening and closing the slide fastener. As viewed in FIG. 1, the tape 10 and the coupling elements 14 form a left stringer of the slide fastener while the tape 12 and coupling elements 16 form a right stringer. The left and right stringers when interlocked together form a chain for the slide fastener. The right stringer is substantially identical to the left stringer except for being a mirror image thereof; thus for the sake of brevity only the left stringer is described in detail herein.

Figure 2:
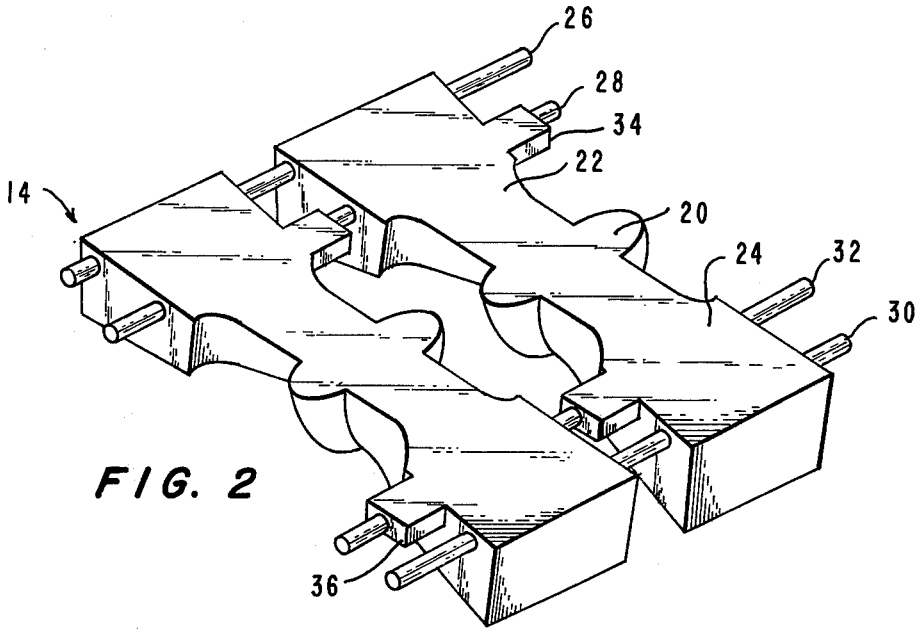
FIG. 2 is a perspective view of a train of unfolded coupling elements after an initial step in forming a stringer for the slide fastener of FIG. 1.
Figure 3:
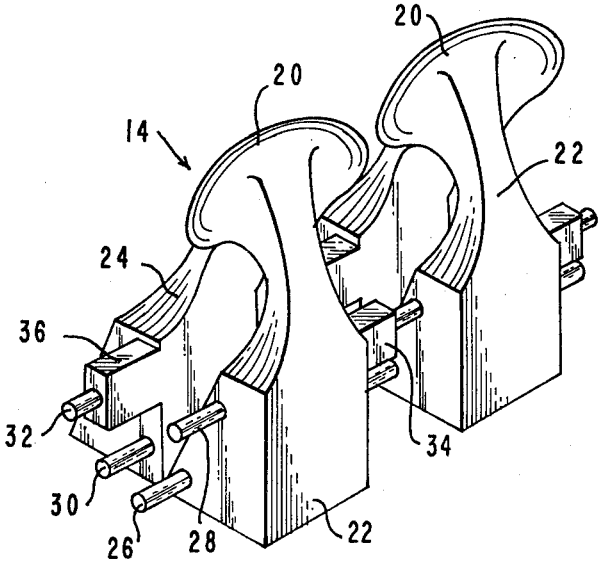
FIG. 3 is a perspective view of the train of coupling elements of FIG. 2 after the elements have been folded.

The train of the coupling elements 14 is initially formed in a flat condition as shown in FIG. 2 and is subsequently folded as shown in FIG. 3 prior to being woven in the inner edge of the tape 10. Each of the coupling elements 14 includes a head portion 20 and a pair of leg portions 22 and 24 extending from opposite sides of the head portion 20. In FIG. 2 the leg portions 22 and 24 extend in opposite directions from the head portions 20, while in FIG. 3 after folding, the leg portions 22 and 24 extend in generally the same direction from the head portions 20. The leg portion 22 is molded around a pair of spaced connecting threads 26 and 28 while the leg portion 24 is molded around a pair of spaced connecting threads 30 and 32. The connecting threads 30, 26, 28 and 32 are parallel with embedded segments of the connecting threads being adjacent the common inside surface, i.e. the upper surface shown in FIG. 2, of the leg portions 22 and 24. The train of coupling elements 14 are molded from a molten polymer, such as a thermoplastic resin, in a suitable injection molding apparatus.

The coupling elements 14 also each have a pair of reinforcing projections 34 and 36 integrally molded therewith, the projection 34 extending in one direction from the leg portion 22 and the projection 36 extending in the opposite direction from the leg portion 24. In prior art trains of molded coupling elements supported by four spaced connecting threads, the reinforcing projections were positioned on the lower connecting threads. It has been discovered that the prior art location and positioning of the reinforcing projections on the lower connecting threads sometimes results in excessive stress on the union of the upper connecting threads with the leg portions 22 and 24 during the opening and closing of coupling elements. Accordingly in the present invention, the reinforcing projections 34 and 36 extend only on the respective upper connecting threads 28 and 32 and are spaced from the lower connecting threads 26 and 30 so as to permit free compression of the lower connecting threads between adjacent coupling elements. The projections 34 and 36 have (1) a thickness, i.e. the dimension perpendicular to the longitudinal direction of the leg portions 22 and 24, which is slightly greater then the thickness of the connecting threads 28 and 32 but substantially less than the thickness of the leg portions 22 and 24, (2) a width, i.e. the dimension parallel to the longitudinal direction of the leg portions 22 and 24, which extends from a point about midway between the upper and lower connecting threads to just above the upper connecting threads, and (3) a length, i.e. the dimension along the connecting threads 28 and 32, which extends slightly more than half the distance between the adjacent coupling elements 14 such that the projections 34 and 36 from respective adjacent coupling elements have end portions which overlap. The projections 34 and 36 are substantially more rigid then the connecting threads 28 and 32.

Figure 4:
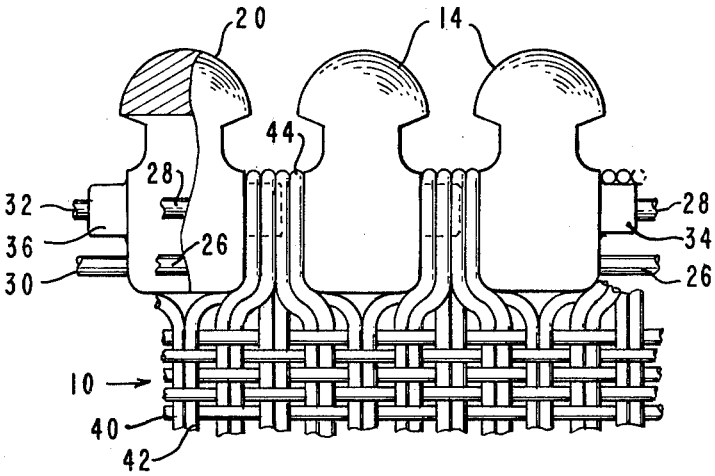
FIG. 4 is an enlarged plan view of a broken away portion of one of the stringers of the slide fastener of FIG. 1.
Figure 5:
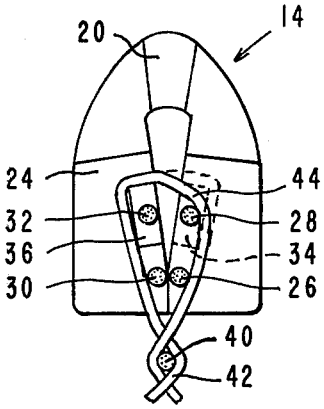
FIG. 5 is a cross-section view of the stringer portion of FIG. 4.

As illustrated in FIGS. 4 and 5, the tape 10 includes a plurality of warp threads 40 with an interwoven weft thread 42 which has plurality of looped portions 44 extending around the connecting threads 26, 30, 28 and 32 and the projections 34 and 36 between each adjacent pair of the coupling elements 14 to secure the train of coupling elements 14 to the edge of the tape 10. Weaving of the weft thread 42 with the warp threads 40 and the train of coupling elements 14 is performed on a conventional slide fastener stringer weaving apparatus. The length to the projections 34 and 36 insures that at least one of more of the loops engage each of the projections 34 and 36 in each space between adjacent elements and that all of the loops 44 are supported by at least one of the projections 34 and 36.

In operation of the slide fastener, the loops 44 of weft thread 42 are retained between the coupling elements to secure the train of coupling elements 14 to the edge of tape 10. The reinforcement projections 24 and 36 bear a substantial portion of the force from the loops 44 to prevent pulling of the connecting threads 26, 28, 30 and 32 from the plastic material of the leg portions of the coupling elements.

Figure 6:
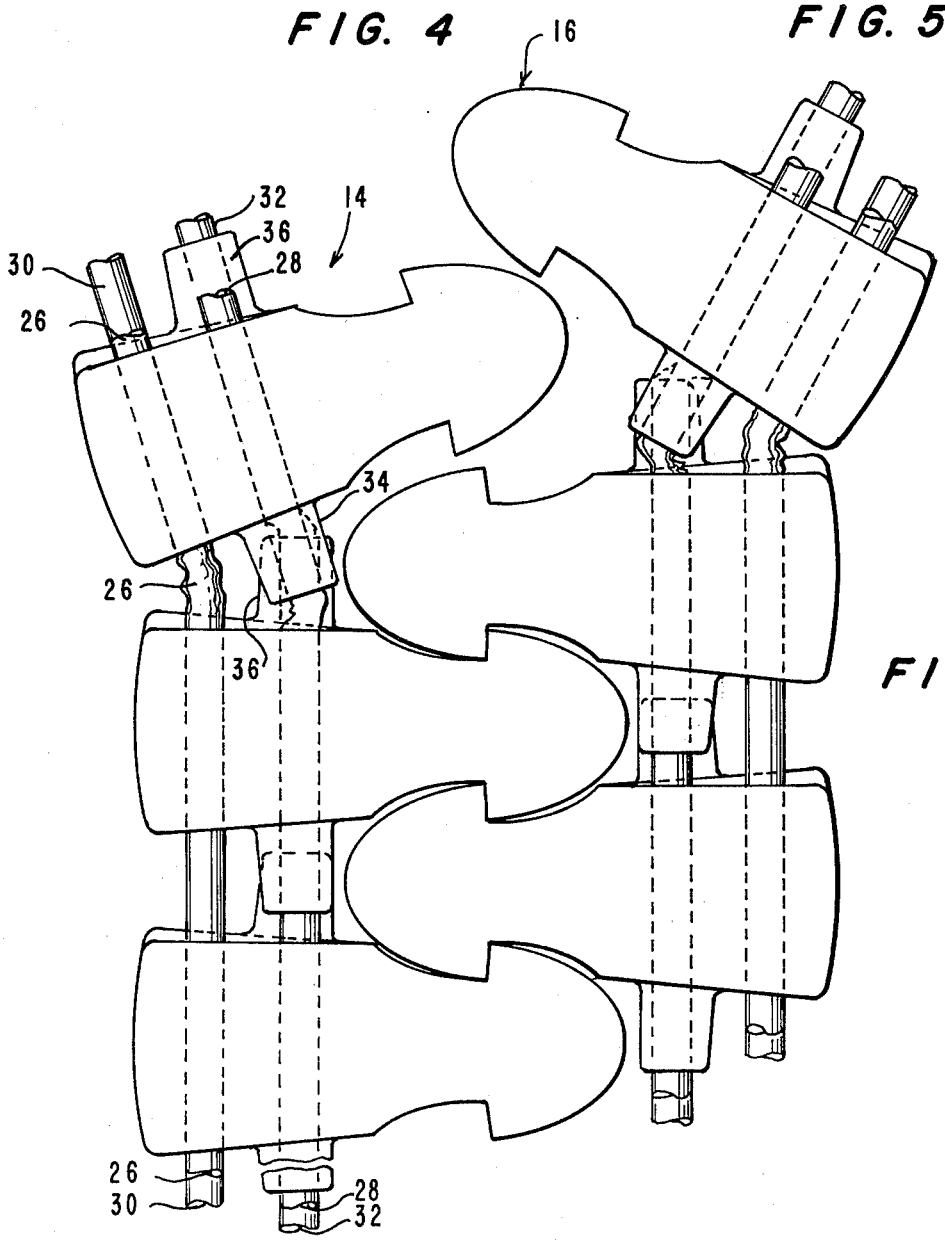
FIG. 6 is an enlarged plan view of a pair of meshing trains of coupling elements shown with the interwoven tape threads removed and particularly illustrating operation of the coupling element trains during opening and closing movement of a slide fastener.

As illustrated in FIG. 6, the positioning of the reinforcing projections along the upper connecting threads 28 and 32 and spaced from the lower connecting threads 26 and 30 permit the lower connecting threads 26 and 30 to compress together, or flex during pivotal rotation movement of the coupling elements 14 and 16 during the opening and closing of the slide fastener. The axis of this bending or rotation movements of the elements during opening and closing is located at points on the upper connecting threads 28 and 32 between the coupling elements. In the prior art, the location of the reinforcing projections along the lower connecting threads prevented free compression of the lower connecting threads causing substantantially greater tension or stretching forces on the upper connecting threads which sometimes resulted in tearing of the upper connecting threads from the leg portions. Thus by positioning the reinforcing projections solely along the upper connecting threads and spaced from the lower connecting threads, failure of the union between the upper connecting threads 28 and 32 and the coupling elements 14 is substantially eliminated. Further, substantially greater pivotal rotation of coupling elements is permitted during the opening and closing which reduces wear on the head locking portions of the coupling elements resulting in increased longitivity for the slide fastener.

Another reason for substantially less failure in the present slide fastener compared to prior art slide fasteners, is that the adhesion between the upper connecting threads and the coupling elements is greatly increased. The upper connecting threads are subjected to the primary force from the weft thread loops 44. Having the projections 34 and 36 molded around and extending along the upper connecting threads 28 and 32 increases the amount of polymer material engaging or adhering to the upper connecting threads to thus increase the adhesion between the connecting threads and coupling elements. Because of this increase of adhesion between the polymer and the connecting threads, substantially less failure of the union between the connecting threads and the coupling elements results.

Since many modifications, variations and changes in detail can be made to the disclosed embodiment of the invention, all matter described in the foregoing description and shown in the accompanying drawings is to be interpreted as only illustrative and not in a limiting sense.

What is claimed is:

1. A woven stringer for a slide fastener comprising a plurality of spaced polymer coupling elements each having a head portion and a pair of leg portions extending in generally the same direction from opposite sides of the head portion and terminating in heels, four connecting threads, respective pairs of which have spaced segments embedded in the respective leg portions to join the coupling elements into a train wherein lower connecting threads are disposed adjacent to the heels of the leg portions and upper connecting threads of the respective pairs of connecting threads are disposed intermediate the heels and the head portions, each coupling element having a pair of integrally molded projections of polymer extending in opposite directions from the respective leg portions of each coupling element along the upper connecting threads, a woven tape having a plurality of warp threads and a weft thread interwoven with the warp threads and the train of coupling elements such that a plurality of loops of the weft thread encircle the four connecting threads and the projections between each adjacent pair of coupling elements, said projections extending only partially across spaces between adjacent coupling elements and being spaced from the lower connecting threads so as to permit free compression of the lower connecting threads between adjacent coupling elements, and said upper and lower connecting threads having respective lengths thereof substantially free of molded polymer between adjacent coupling elements wherein the lengths of lower connecting threads substantially free of molded polymer are substantially greater in length than the lengths of upper connecting threads free of molded polymer.

2. A woven stringer as claimed in claim 1 wherein the projections are molded completely around the respective upper connecting threads.

3. A woven stringer as claimed in claim 1 or 2 wherein projections extending from adjacent coupling elements have end portions which overlap.

* * * * *